United States Patent [19]

Zipperian

[11] Patent Number: 4,639,313

[45] Date of Patent: Jan. 27, 1987

[54] FLOATATION APPARATUS FOR CONCENTRATION OF MINERALS FROM HIGH WATER CONTENT AQUEOUS SLURRIES

[75] Inventor: Donald E. Zipperian, Tucson, Ariz.

[73] Assignee: The Deister Concentrator Company, Fort Wayne, Ind.

[21] Appl. No.: 752,465

[22] Filed: Jul. 5, 1985

[51] Int. Cl.[4] ..... B03D 1/24

[52] U.S. Cl. ..... 209/170; 209/168; 261/78.2; 210/221.2

[58] Field of Search ..... 209/170, 168; 261/78 A, 261/DIG. 75; 210/221.1, 221.2

[56] References Cited

U.S. PATENT DOCUMENTS

| | | | |
|---|---|---|---|
| 2,883,167 | 4/1959 | Krantz | 261/78 A X |
| 2,883,169 | 4/1959 | Daman | 209/170 X |
| 3,371,779 | 3/1968 | Hollingsworth | 209/170 X |
| 3,642,617 | 2/1972 | Brink et al. | 209/170 X |
| 4,054,619 | 10/1977 | Coverston | 261/78 A X |
| 4,287,054 | 9/1981 | Hollingsworth | 209/170 |
| 4,328,107 | 5/1982 | Wright | 261/78 A X |
| 4,394,258 | 7/1983 | Zipperian | 209/170 |
| 4,431,531 | 2/1984 | Hollingsworth | 210/221.2 X |

*Primary Examiner*—S. Leon Bashore
*Assistant Examiner*—Thomas M. Lithgow
*Attorney, Agent, or Firm*—Pearne, Gordon, McCoy & Granger

[57] ABSTRACT

The invention relates to the concentration and beneficiation of particulate matter by froth flotation and in particular to improvements in hydraulic-pneumatic flotation apparatus which contribute to the efficiency of operation. Such apparatus employs a constriction plate which separates vertically arranged flotation and hydraulic compartments. A discharge duct may be used to extend through the hydraulic compartment and to open through the constriction plate centrally thereof.Orifices in both the constriction plate are in communication with the hydraulic compartment to provide a uniform dispersion of air bubbles in the flotation compartment. Aerated water distribution manifolds within the hydraulic compartment and within the lower portion of the flotation compartment are provided to enter the aerated water into the flotation compartment substantially uniformly throughout a horizontal cross-section thereof. In order to minimize the energy consumption of the apparatus and to provide for the introduction of aerated water at a reduced flow rate, amenable to the separation of aqueous pulps having a low concentration of solid matter by volume, such as sulfides, a stream of pressurized air is passed through an eductor wherein a mixture of water and, if desired, an appropriate surfactant is aspirated into the stream of flowing pressurized air. The flowing stream of pressurized air and the aspirated water and surfactant are then passed through a venturi region, producing a highly aerated, low water volume stream of aerated water for delivery to the hydraulic compartment.

17 Claims, 8 Drawing Figures

FLOATATION APPARATUS FOR CONCENTRATION OF MINERALS FROM HIGH WATER CONTENT AQUEOUS SLURRIES

BACKGROUND OF THE INVENTION

1. Field of the Invention

This invention relates to particulate separation of material from an aqueous slurry by a dissolved air flotation system, and more particularly to a system wherein flotation air is introduced by flowing pressurized air through an eductor and venturi to aspirate a low volume flow rate of water thereinto.

2. Description of the Prior Art

Commercially valuable minerals, for example metal sulfides, apatitic phosphates and the like, are commonly found in nature mixed with relatively large quantities of gangue materials, and as a consequence it is usually necessary to beneficiate the ores in order to concentrate the mineral content thereof. Mixtures of finely divided mineral particles and finely divided gangue particles can be separated and a mineral concentrate obtained therefrom by well known froth flotation techniques. Broadly speaking, froth flotation involves conditioning an aqueous slurry or pulp of the mixture of mineral and gaugue particles with one or more flotation reagents which will promote flotation of either the mineral or the gangue constituents of the pulp when the pulp is aerated. The conditioned pulp is aerated by introducing into the pulp a plurality of minute air bubbles which tend to become attached either to the mineral particles or the gangue particles of the pulp, thereby causing one category of these particles, a float fraction, to rise to the surface of the body of pulp and form thereat a froth which overflows or is withdrawn from the flotation apparatus. The other category of particles, a non-float fraction, tends to gravitate downwardly through the aqueous pulp, and it may be withdrawn at an underflow outlet from the flotation apparatus. Typical examples of such flotation apparatus for accomplishing the foregoing are disclosed in U.S. Pat. Nos. 2,753,045; 2,758,714; 3,298,519; 3,371,779; 4,287,054 and 4,394,258.

In such apparatus, the conditioned pulp is introduced into a flotation compartment containing a relatively quiescent body of aqueous pulp and aerated water is introduced into the lower portion of the flotation compartment through orifices formed in the bottom wall of the flotation compartment. An overflow fraction containing floated particles of the pulp is withdrawn from the top of the body of aqueous pulp and an underflow or non-float fraction containing non-floated particles of the pulp is withdrawn from the pulp in the lower portion of the flotation compartment.

In several of the heretofore known systems, the aerated water is produced by first introducing, by injection, a frother or surfactant into the water, which mixture is then passed through an eductor wherein air is aspirated into the water. In order to obtain a proper degree of aeration of the water, a high flow rate of water, typically in excess of 1,000 gallons per minute, must be passed through the eductor. While recirculation systems have been devised to minimize the amount of "new" water added to the system, a significant expenditure in energy is required to move such large quantities of water.

A further problem encountered arises from the difference between the concentrations of solid particles present in slurries of different minerals. Phosphates, for example, do not typically require extensive grinding in order to liberate the desired mineral components of the pulp. As a result, the aqueous slurry or pulp fed to the flotation apparatus typically consists of approximately seventy-five percent (75%) solids and twenty-five percent (25%) water. Sulfides, on the other hand, approach the obverse extreme and typically require extensive beneficiation through grinding the material to a very fine state in order to gain liberation of the desired minerals from the gangue. The addition of water throughout the sorting, grinding and classifying stages of the beneficiation process provides a resulting aqueous slurry to the flotation device comprising approximately ten percent (10%) solid matter and ninety percent (90%) water. Thus, the addition of significant additional amounts of water through the introduction of the aerated water appears counter-productive in that significant amounts of the finely ground valuable minerals may avoid capture by the aeration bubbles and remain suspended within the liquid component of the slurry. If a recirculation system is utilized, much of the finely ground material may be passed through the recirculation system which may cause silting of the recirculation system or loss of a significant quantity of finely ground valuable minerals or both. Ideally, to avoid loss of such valuable minerals, additional air bubbles should be introduced into the aerated water. This in turn has heretofore required the introduction of still greater additional amounts of water to the system.

SUMMARY OF THE INVENTION

It is a primary object of the present invention to provide a flotation apparatus for the concentration of minerals which requires the introduction of minimal amounts of water.

It is another object of the present invention to provide a flotation apparatus for the concentration of minerals which is capable of varying the concentration of air in the introduced aerated water without significantly varying the water flow rate.

It is a further object of the present invention to provide a flotation apparatus for the concentration of minerals requiring significantly reduced operating energy consumption, thereby providing more economic operation.

It is yet another object of the present invention to provide a flotation apparatus for the concentration of minerals from which does not require an internal water recirculating system.

It is a still further object of the present invention to provide a flotation apparatus for the concentration of minerals which is significantly more tolerant of sanding or silting from the non-float fraction of the aqueous slurry or pulp.

The above-mentioned and other features and objects are achieved in an apparatus in accordance with the present invention comprising;

a flotation compartment adapted to contain a relatively quiescent body of aqueous pulp;

a pulp feed well, disposed near the top of the flotation compartment, to which an aqueous pulp is introduced and disbursed into the flotation compartment;

a froth overflow launder, disposed adjacent to the upper end of the flotation compartment, into which a float fraction containing floated particles of the aqueous pulp is discharged;

a hydraulic compartment, disposed beneath the flotation compartment, adapted to contain a body of aerated water maintained at a higher static pressure than that of the aqueous pulp in the lower portion of the flotation compartment;

a constriction plate separating the flotation compartment from the hydraulic compartment, the constriction plate having a plurality of spaced orifices for uniformly distributing aerated water therethrough from the hydraulic compartment in transit to the flotation compartment;

an underflow outlet for discharging a nonfloat fraction of the aqueous pulp from the flotation compartment; and a subsystem means for producing aerated water and for introducing the aerated water into the hydraulic compartment.

The primary method and apparatus for producing the aerated water of the flotation apparatus in accordance with the present invention includes flowing pressurized air through an eductor, aspirating water into the air at the eductor, and, if desired, an injection port for introducing a surfactant or frother into the water prior to the aspiration thereof. The construction and manner of operation of such apparatus will best be understood by reference to the following description of an embodiment of the invention taken in conjunction with the accompanying drawings.

Figure 1:
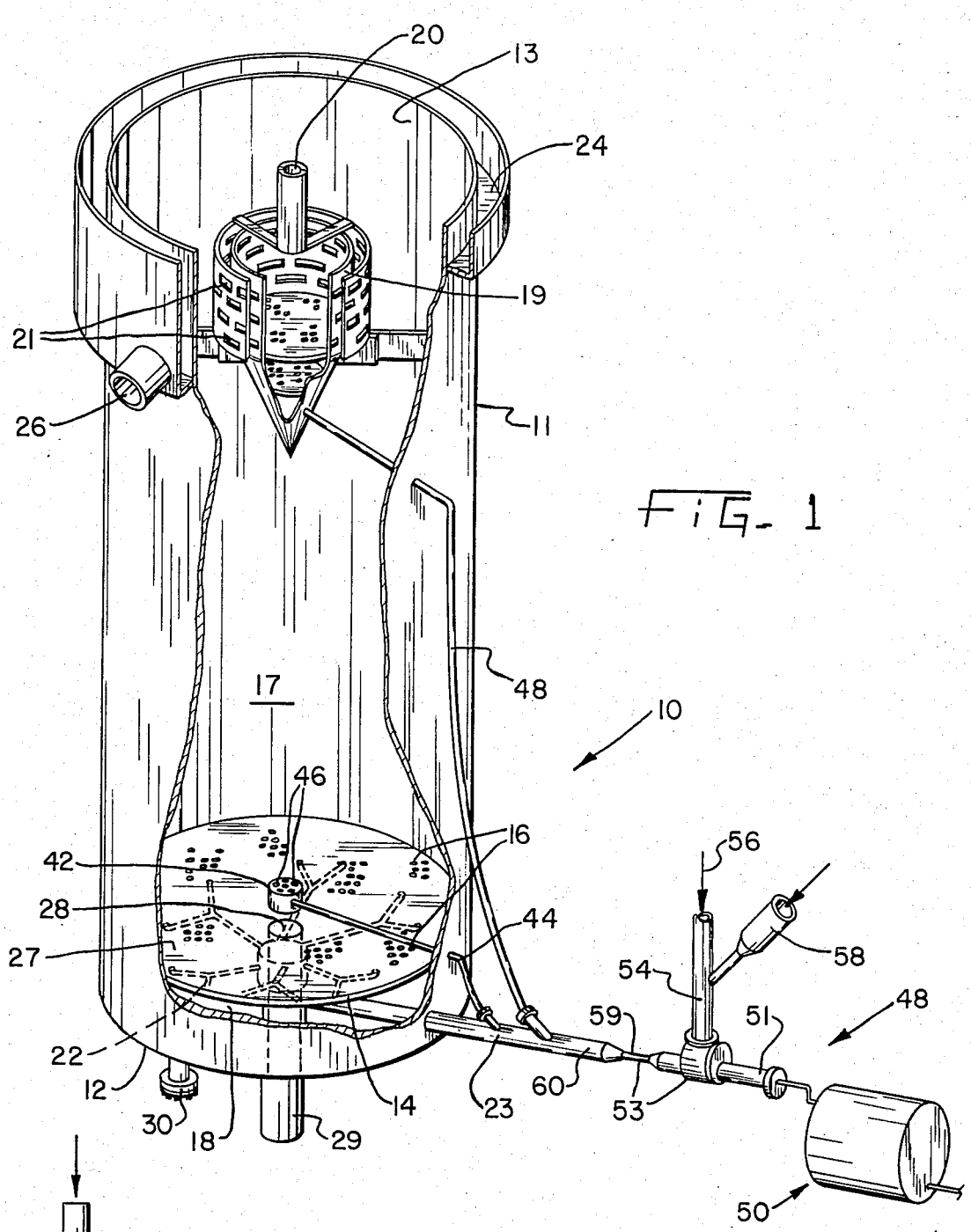
FIG. 1 is a perspective view partially broken away in section for clarity of illustration of a flotation apparatus of the type to which the present invention relates.
Figure 2A:
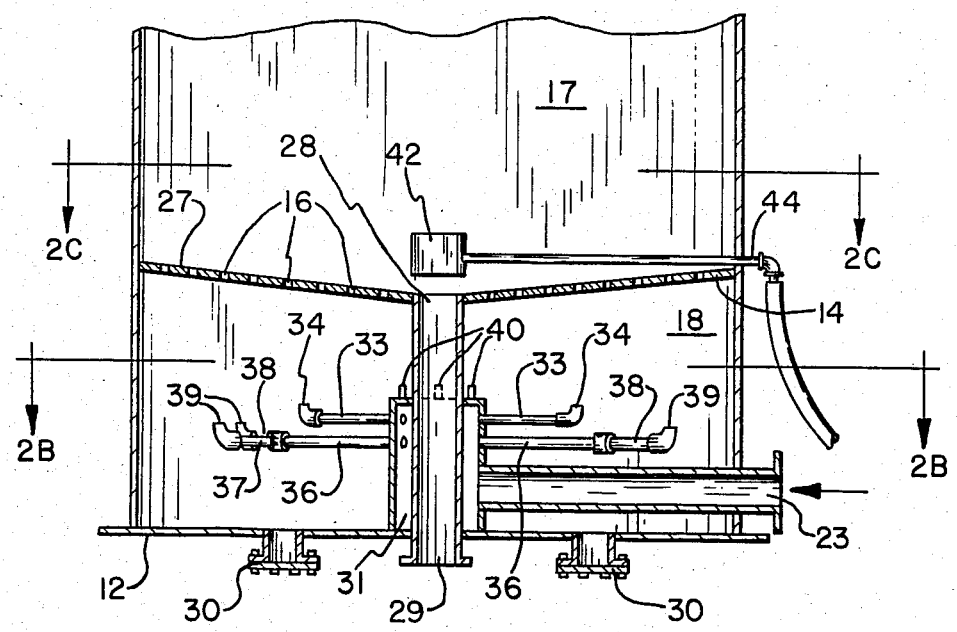
FIG. 2*a* illustrates a side sectional view of a lower portion of the flotation apparatus of FIG. 1.
Figure 2B:
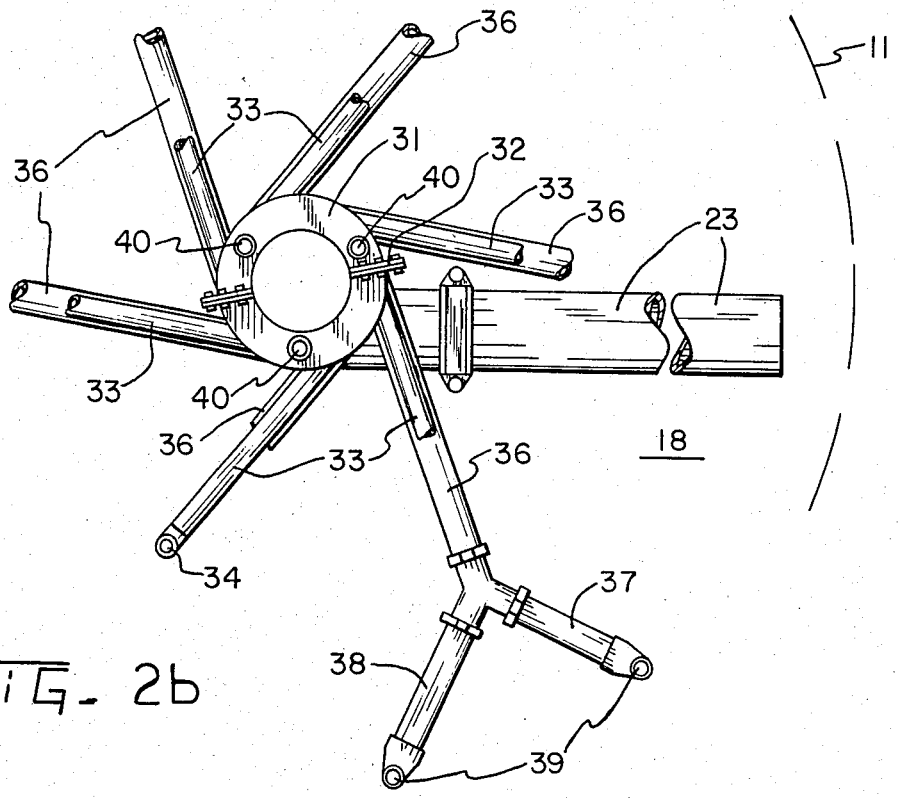
FIG. 2*b* presents a top view of the apparatus of FIG. 1 taken along the section B—B of FIG. 2*a;*
Figure 2C:
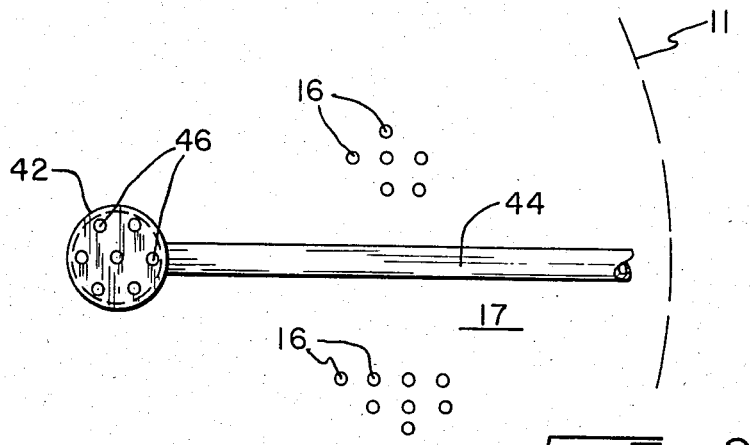

FIG. 2*c* presents a top view of the apparatus of FIG. 1 taken along the section C—C of FIG. 2*a;*

Figure 3:
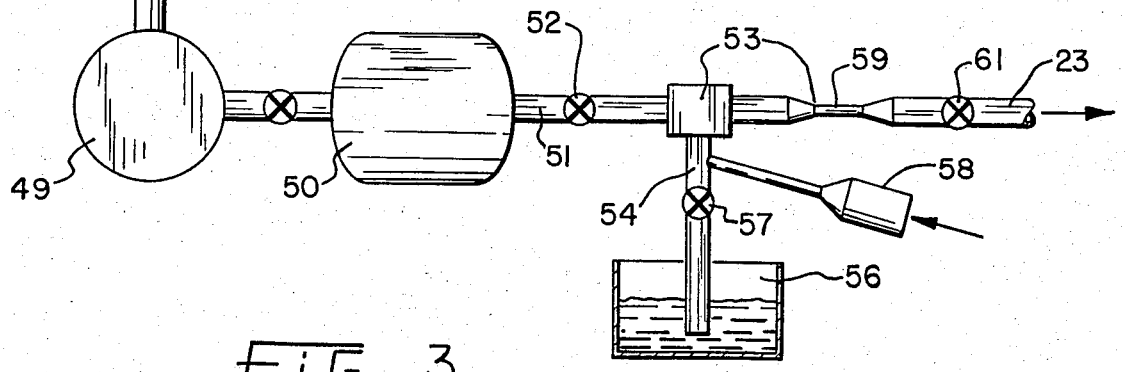

FIG. 3 schematically illustrates, in greater detail, that portion of the flotation apparatus of FIG. 1 wherein aerated water is generated.

Figure 5:
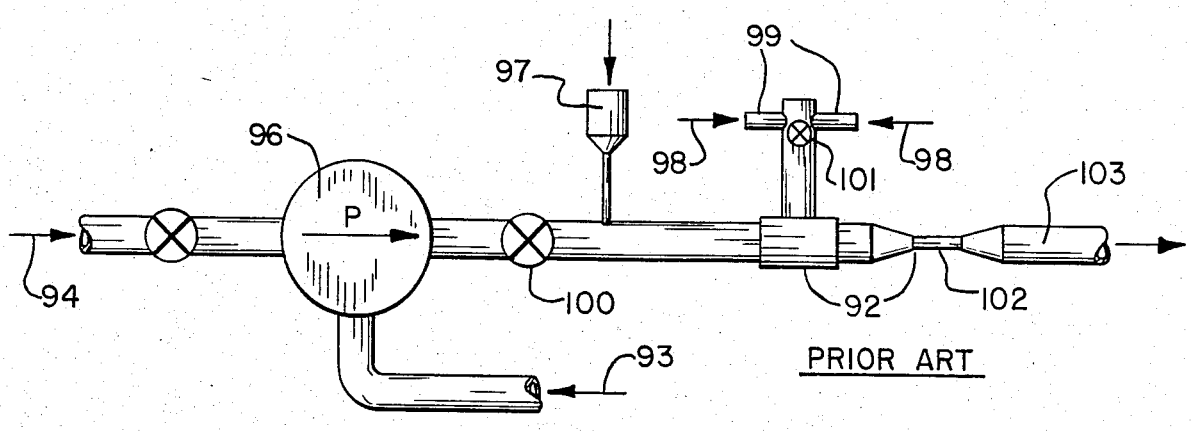
Figure 4:
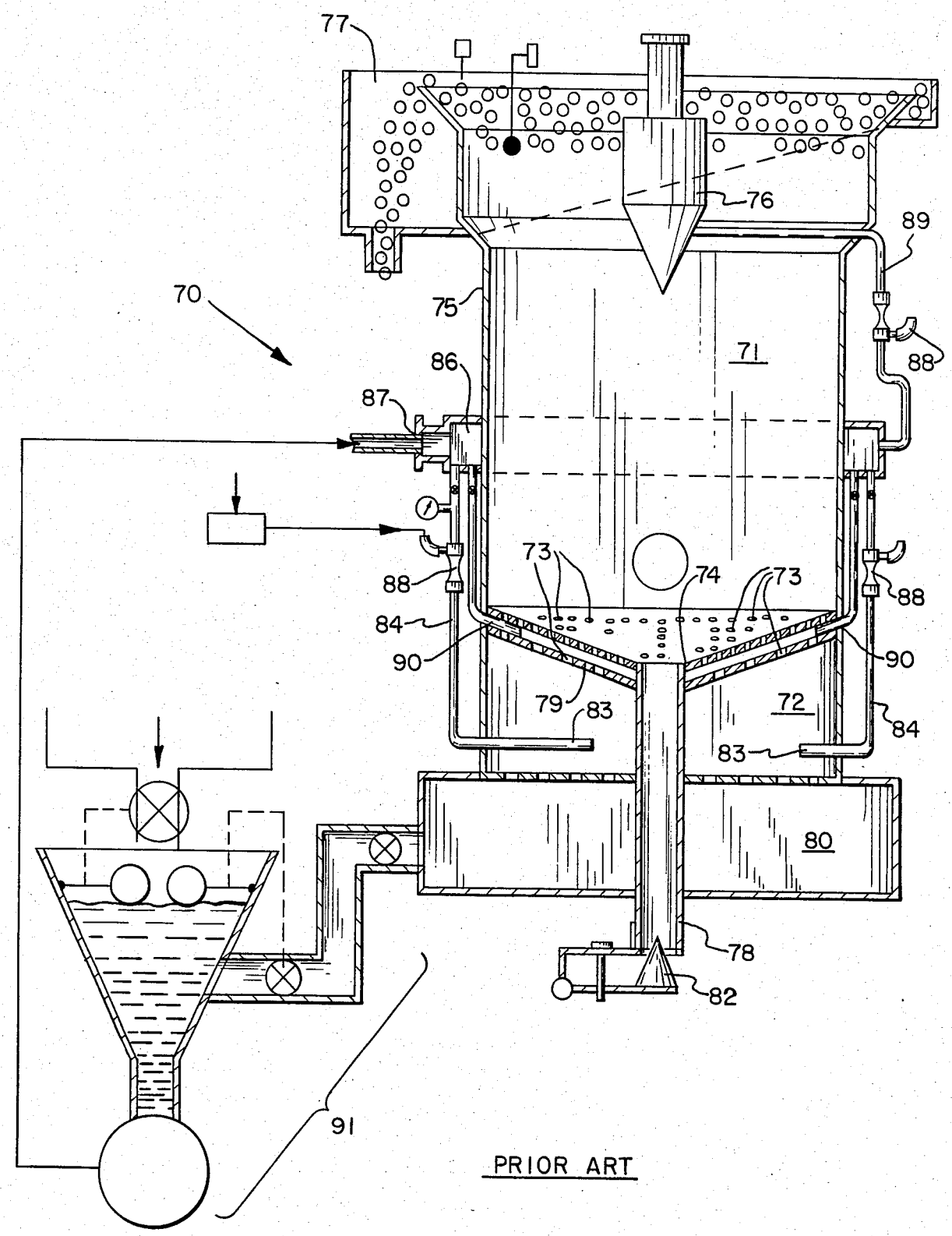
PRIOR ART FIG. 4

FIG. 4 is a side cross-sectional view, partially schematic for clarity of illustration, of a flotation apparatus representative of the prior art; and FIG. 5 schematically illustrates a subsystem for producing aerated water, as typically incorporated in the known flotation apparatus of FIG. 4.

Figure 6:
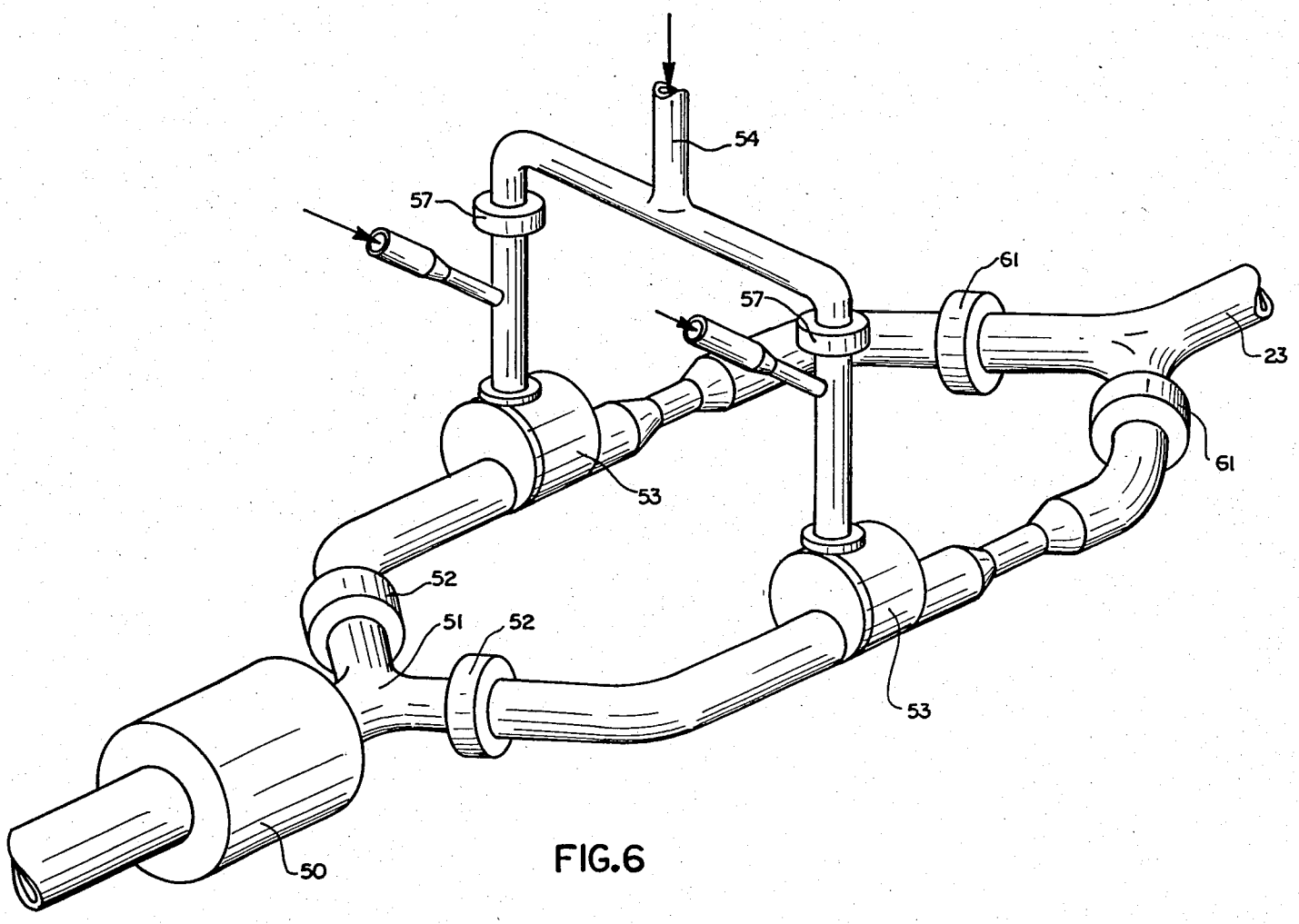

FIG. 6 is a schematic illustration similar to FIG. 5 showing an alternate form of subsystem for producing aerated water.

DESCRIPTION OF THE PREFERRED EMBODIMENT

Referring first to FIG. 1, a preferred embodiment of a flotation apparatus in accordance with the present invention is indicated generally at 10. The flotation apparatus 10 can be noted to have a plurality of elements which may be grouped, for convenience, into a flotation cylinder, wherein an aqueous slurry of suspended mineral and gangue particles is separated into a float fraction and a non-float fraction, an aerated water distribution system, and an aerated water production subsystem. Each group of components will be hereinbelow described and functionally interrelated in detail.

The flotation cylinder is formed as an upright circular cylinder having a vertical wall 11 and a bottom wall 12. The flotation cylinder is typically open at an upper end 13 thereof. A substantially horizontally disposed constriction plate 14, having a plurality of spaced orifices 16, which may be tapered with the smaller diameter at the top, is located within the cylinder so as to separate the cylinder into a flotation compartment 17, above the constriction plate 14, and a hydraulic compartment 18, below the constriction plate 14. Both the flotation compartment 17 and the hydraulic compartment 18 are adapted to contain relatively quiescent bodies of liquid, with the orifices 16 in the constriction plate 14 serving as communicating passages between the hydraulic compartment 18 and the flotation compartment 17. A pulp feed well 19 is supported substantially centrally within the upper end portion 13 of the flotation compartment 17. A feed tube 20, from an external source of aqueous slurry, is generally provided to deliver a controllable quantity of the aqueous slurry to the feed well 19. The feed well 19 has a plurality of apertures 21 therethrough, which may include baffles (not illustrated) such that the aqueous slurry fed into the feed well 19 becomes distributed throughout the flotation compartment 17.

The hydraulic compartment 18 contains a relatively quiescent body of aerated water which is substantially uniformly distributed throughout the volume of the hydraulic compartment 18 by a distribution manifold 22. Details of the preferred embodiment of the distribution manifold will be set forth below. The introduction of a flow of aerated water into the hydraulic compartment 18 through the distribution manifold 22 tends to produce a higher static pressure of the aerated water within the hydraulic compartment 18 than that obtained within the body of aqueous slurry within the flotation compartment 17 immediately above the constriction plate 14. This difference in static pressure causes a portion of the aerated water contained in the hydraulic compartment 18 to flow upwardly through the orifices 16 in the constriction plate 14, thereby inhibiting any downward flow of aqueous slurry, or the particulate matter suspended therein, through said orifices 16 into the hydraulic compartment 18. An aerated water feed line 23 enters the hydraulic compartment 18 through the cylinder wall 11 and conveys aerated water from the production subsystem to the distribution manifold 22.

In addition to precluding the downward migration of aqueous slurry, or solid particulate matter suspended therein, through the orifices 16 in the constriction plate 14 by the flow of aerated water upwardly through the orifices 16, the aerated water within the compartment 18 contains a multitude of minute air bubbles which levitate through the aqueous slurry within the flotation compartment 17. Aided by the inclusion of an appropriate one of a number of known reagents, commonly known as surfactants or frothers, either the particles of the desired valuable mineral or the particles of gangue suspended in the aqueous slurry are captured, as a float fraction, by the rising air bubbles and carried to the surface at the upper end 13 of the flotation compartment 17 in the form of a froth. An overflow launder 24 is affixed annularly to the upper end 13 of the cylinder wall 11 into which the resulting froth overflows from the flotation compartment 17. An output conduit 26 is provided to convey the overflowing froth from the launder 24 to further processing or storage apparatus external to the flotation apparatus 10.

The solid particulate matter not so captured by the levitating air bubbles, forming a non-float fraction, gravitates downwardly through the aqueous slurry until it reaches the vicinity of the constriction plate 14. As illustrated in FIG. *2a*, the constriction plate 14 has a downwardly concave upper surface 27. The continued gravitation of the solid non-float fraction particles therefore continues along the upper surface 27 of the constriction plate 14 until the lowest portion thereof, disposed substantially centrally of the cylinder, is reached. It is to be re-emphasized that the upward flow of aerated water through the orifices 16 in the constriction plate 14 inhibits such particles from gravitating downwardly through the orifices 16. A hole 28 is formed through the constriction plate 14 at its central area into which the gravitating non-float fraction may enter. An underflow duct 29 is rigidly affixed to the rim of the hole 28 and depends therefrom to sealably pass through the bottom wall 12 of the cylinder. A valve (not illustrated) may be incorporated at the lower end of the underflow duct 29 to control the outflow of water and non-float fraction of the aqueous pulp. It is contemplated that in the flotation apparatus in accordance with the present invention, the valve controlling the outflow through the underflow duct 29 need be opened only as required to remove the non-float fraction, since no continuous liquid flow is necessary. Additionally, cleaning entry ports 30 may be incorporated in the bottom wall 12 of the cylinder to enable cleaning of the hydraulic compartment 18 from time to time.

Referring next to FIGS. *2a*, *2b* and *2c*, the distribution manifold 22, disposed within the hydraulic compartment 18 is illustrated in greater detail. The aerated water feed line 23, upon entering the hydraulic compartment 18 through the cylinder wall 11, is coupled to a distribution chamber 31. The distribution chamber 31 annularly surrounds the underflow duct 29 and may be formed as a pair of half cylinders coupled together by a flange 32 to form an annular enclosure around the circumference of the underflow duct 29. As shown, the aerated water feed line 23 enters the chamber 31 at its lower portion in a location substantially tangential to the outer wall of the underflow duct 29 so that the aerated water will circulate through the chamber 31. A plurality of distribution pipes extend outwardly from the upper portion of the distribution chamber 31 in a manner providing for introduction of aerated water into the hydraulic compartment 18 below the constriction plate 14 at a plurality of horizontally spaced positions. In the preferred embodiment, two sets of distribution pipes are utilized. A plurality of distribution pipes of a first tyoe 33 extend substantially tangentially outwardly in a horizontal plane from the uppermost portion of the distribution chamber 31, each terminating in an upwardly directed nozzle 34. The plurality of nozzles 34 are located substantially equiangularly about a horizontal circle having a diameter substantially half that of the hydraulic compartment 18. In the preferred embodiment, six distribution pipes of the first type 33 having nozzles 34 are utilized, although any convenient number may be incorporated so as to evenly distribute the aerated water.

A like plurality of distribution pipes of a second type 36 are disposed to extend substantially tangentially outwardly from the distribution chamber 31 at a vertical elevation on the distribution chamber 31 below that at which the distribution pipes of the first type 33 are disposed and above that at which the aerated water feed line 23 enters the distribution chamber 31. Each of the distribution pipes of the second type 36 branch through an outwardly extending Y extension into two arms 37 and 38, each terminating in an upwardly directed nozzle 39. The lengths of the arms 37 and 38 are adapted such that the nozzles 39 are substantially equiangularly spaced about a horizontal circle having a radius approximately eighty percent (80%) of the radius of the hydraulic compartment 18.

As can be noted from FIG. *2b*, the substantially tangential coupling of the aerated water feed line 23 to the distribution chamber 31 tends to cause the aerated water entering the chamber 31 to circulate in a substantially clockwise annular flow when viewed from the top. The substantially tangential coupling of the distribution pipes of the first type and the second type 36 to the distribution chamber 31 provides that such clockwise annular flow will tend to be introduced into each of the distribution pipes 33 and 36 in approximately equal amounts.

In the preferred embodiment illustrated, three additional nozzles 40 are coupled to an upper face 41 of the distribution chamber 31 to provide for distribution of aerated water in the central portion of the hydraulic compartment 18 surrounding the underflow duct 29. The nozzles 40 may be canted with respect to a vertical axis so that the aforesaid clockwise annular flow of aerated water within the distribution chamber 31 may more readily enter said nozzles 40.

Since that portion of the flotation compartment 17 disposed vertically over the hole 28 in the constriction plate 14 to which to the underflow duct 29 is attached may not be provided with aerated water flowing upwardly through the orifices 16 of the constriction plate 14, an auxiliary aerated water distribution cylinder 42 may be incorporated within the lower portion of the flotation compartment 17. The cylinder 42 has a horizontal diameter approximately equal to but greater than the diameter of the hole 28. The cylinder 42 is provided with a supply of aerated water by a secondary aerated water feed line 44 entering through the cylinder wall 11 from a coupling with the aerated water feed line 23 external of the cylinder of the flotation apparatus 10. The cylinder 42 is provided with a plurality of upwardly directed apertures 46 adapted to provide a distribution of levitating air bubbles within the aforesaid portion of the flotation compartment 17 disposed vertically over the hole 28 in the constriction plate 14.

Referring briefly again to FIG. 1, the aerated water feed line 23 may include a further branch 48 external of the cylinder of the flotation apparatus 10, which branch 48 may be directed to the feed well 19 near the top of the flotation compartment 17. The supply of aerated water to the feed well 19 in this manner is well understood and is described more fully in U.S. Pat. No. 4,394,258.

Referring next to FIG. 3, an isolated schematic representation of the aerated water production subsystem, indicated generally at 48, illustrates the interrelationships of the several components forming such a subsystem. The primary flow medium is compressed air, nominally at a pressure of approximately twenty pounds per square inch. Atmospheric air is compressed in a compressor 49 of a known, typically electric, type and the compressed air may then be stored in an accumulator or reservoir 50. An enclosed air flow passage, typically in the form of a tube 51, directs the compressed air from the reservoir 50 through a flow controlling valve 52 to an eductor 53. The tube 51 is, in the preferred embodiment, formed of appropriately coupled pipe segments having a nominal diameter of from one to six inches, dependent upon cell size, with lengths commensurate to the particular installation of the apparatus 10, a diameter of about one inch for a cell of thirty inches, two inches for a cell of five and one-half feet, and three inches for a cell of eight feet. Within the eductor 53, the compressed air flows past an aspirating opening (not illustrated) to which an input water line 54, also having a nominal six inch diameter, is attached. Input water, nominally at atmospheric pressure, is drawn by aspiration induced by the air flowing through the eductor 53 past the opening, into the input line 54 from an external water source 56. The input water line 54 may include a valve 57 to control the water flow, as necessary. A quantity of a desired surfactant or frother may be flowingly introduced into the water at a controllable rate through a valve port 58 so as to enter and mix with the flowing aspirated water in the input water line 54. The flowing air, aspirated water and the surfactant are then passed through a venturi region 59 of the eductor 53 in which the flow rate and pressure relationship common to venturi-type devices are employed to turbulently combine the air into the aspirated water and, if present, surfactant so as to form a multitude of small bubbles in the aerated water. The aerated water is then conveyed via a pipe 60, through a valve 61, to the aerated water feed line 23 for delivery to the distribution manifold 22 (FIG. 2*a*) and elsewhere as previously described. In order to increase the multiplicity of air bubbles in the aerated water so produced, the preferred embodiment incorporates a parallel arrangement of two eductors 53, such that the air from the reservoir 50 flows through the tube 51 which branches into two tubes, each containing a valve 52, an eductor 53, and a flow control valve 61, before again uniting to form the aerated water feed line 23. Similarly, the input water line 54 is branched into a pair of parallel lines through valves 57 to enter each eductor 53, respectively. This arrangement is illustrated in FIG. 6.

In order to gain a more complete understanding of the operation of a flotation apparatus 10 in accordance with the present invention, and to distinguish the added features thereof and simplification as to prior known flotation separation systems, an understanding of a flotation apparatus typical of the prior art is desirable. Therefore, referring to FIG. 4, an example of a known flotation apparatus, as typified by that described in U.S. Pat. No. 4,394,258, is indicated generally at 70. The flotation apparatus 70 comprises a flotation compartment 71 adapted to contain a body of aqueous pulp to be separated into float and nonfloat fractions, a hydraulic compartment 72 disposed directly below the flotation compartment 71 and adapted to contain a body of aerated water that is introduced to the flotation compartment through orifices 73 formed in a constriction plate 74 which serves as the bottom wall of the flotation compartment 71. An apertured pulp feed well 76 is provided adjacent to an upper end of the apparatus for introducing an aqueous pulp into the flotation compartment 71. An annular froth overflow launder 77 is provided adjacent to the upper end of the flotation compartment 71 for withdrawing the float fraction therefrom. A low velocity underflow discharge duct 78 is provided adjacent to the lower end of the flotation compartment 71 for withdrawing underflow or nonfloat material from the flotation compartment 71.

The flotation compartment 71 and the hydraulic compartment 72 are contained within a common cylindrical wall 75. A second constriction plate 79, having a similar set of orifices 73, is spaced below and extends parallel to the constriction plate 74 so as to form a volume therebetween. A water collecting or recovery compartment 80 is disposed beneath the hydraulic compartment 72. A plurality of apertures are provided to enable fluid communication between the collecting compartment 80 and the hydraulic compartment 72. The underflow discharge duct 78 is substantially centered and is sealingly secured at its upper end to an opening 81 through the constriction plate 74. The constriction plate 79, the interface between the hydraulic compartment 72 and the collecting compartment 80, and the bottom wall of the apparatus are sealingly secured to the outer periphery of duct 78. A valve 82 is disposed for movement within the lower end of the duct 78 to control the rate of discharge of water and non-float fraction from the flotation compartment 71.

Since the hydraulic compartment 72 should, for proper operation of the flotation apparatus 70, contain a uniformly aerated body of water maintained at a slightly higher static pressure than that of the aqueous pulp in the flotation compartment 71, the hydraulic compartment 72 is provided with a plurality of radially inwardly directed aerated water feed pipes 83 of several differing lengths introducing aerated water thereinto. These pipes 83 are externally connected to pipes 84 leading to an annular water manifold 86 having a fitting 87 to which water at a pressure of, for example, twenty-five to fifty pounds per square inch is connected. In series with each of the pipes 84 is a conventional aspirator 88. Such aspirators, serving to introduce air into the flowing water, may be the same as that shown and described in U.S. Pat. No. 3,371,779.

Another pipe 89 may be connected at one end to the manifold 86 and at the other end to the feed well 76. An aspirator 88 is connected in series with the pipe 89. A further plurality of pipes 90, without aspirators, are directed from the annular manifold 86 radially into the aforesaid volume between the constriction plates 74 and 79 and serve to provide additional static pressure in said volume. This added water, known as seal water, aids in precluding the downward migration of non-float fraction particles through the orifices 73.

In order to minimize the quantity of additional water necessary during operation of the flotation apparatus 70, water, generally free of aeration, migrates downwardly from the hydraulic compartment 72 through the apertures into the collecting compartment 80 from whence water is recirculated through a pumping system 91 to the fitting 87 on the annular manifold 86. "New" water is added at the pumping system 91 as may be necessary to replace that leaving the system through the overflow launder 77 and the underflow duct 78.

Referring next to FIG. 5, an example of an alternate approach to the production of aerated water for use in the previously described flotation apparatus 70 utilizes one or more parallelly disposed eductors 92, disposed external to the flotation compartment 71 of FIG. 4. Water, comprising an appropriate combination of recirculating water 93, withdrawn from the collecting compartment 80, and new water 94, added from a source external to the system, is delivered by a pump 96 at a substantially high flow rate, typically of the order of one thousand gallons per minute or greater, to each eductor 92. Additionally, an appropriate quantity of one of the usual surfactants, frothers, or other flotation reagents may be introduced to the water flow through an injection device 97 disposed at a point in the flow path subsequent to the pump 96 but before the eductor 92. At the eductor 92, atmospheric air 98 is aspirated by water flowing through the eductor 92, the air entering through appropriate ports 99. A valve 100 and a valve 101 may be incorporated to control the water and air flow rates, respectively. By passing the water and aspirated air through a venturi region 102 of the eductor 92, an appropriate admixture of air bubbles in the water is generated, which is then delivered, through a communciating pipe 103, to the annular manifold 86 (FIG. 4) surrounding the flotation compartment 71. It is to be noted that when such an external eductor 92 is incorporated into the flotation apparatus 70, the aspirators 88 may be omitted. Moreover, the structure of the lower portion of the cylinder of the flotation apparatus 70 may, with reference to FIG. 4, be simplified by introducing the aerated water so produced directly into the hydraulic compartment 72 through a single pipe through the cylinder wall 75 for direct distribution to spaced apart internal manifolds disposed within the hydraulic compartment 72. A more complete description of the apparatus and its operation may be found by reference to U.S. Pat. Nos. 4,287,054 and 4,394,258.

In an apparatus 10 in accordance with the present invention, an aqueous slurry fed thereto is typically of a high water concentration, wherein the solid particulate matter, consisting of both the float and non-float fractions, is generally of the order of ten percent (10%) by volume. In such an aqueous slurry, the addition of quantities of water, as is typical of prior known systems, will substantially further reduce the solid matter concentration. Since a nearly equal amount of water or aqueous slurry must be continuously withdrawn as the "new" water is added, to prevent overflow of the flotation compartment, some of the small particles of the desired valuable mineral, suspended in the aqueous slurry, may not have been captured by air bubbles and levitated to the froth. Such non-captured particles may thus be conveyed from the flotation compartment 17 with the liquid withdrawn therefrom to accommodate the added aerated water. The present invention significantly reduces the loss of valuable minerals in the above stated manner by limiting the quantity of water introduced to the flotation compartment 17 to that aspirated at the eductor 53 and transported as aerated water therefrom to the flotation compartment 17. Typically, in order to provide a sufficient flow of air bubbles levitating through the aqueous slurry, the water flow rate will be approximately one hundred gallons per minute, which is roughly equivalent to the rate of removal of the float fraction through the overflow launder 24, disposed at the top of the flotation compartment 17.

It has been experimentally observed that the rate of flow of air into the eductor 53 may be varied over a significant range of flow rates without significantly altering the flow rate of the water into the eductor 53 and thence into the flotation compartment 17. Thus, the concentration of air bubbles in the aerated water emanating from the eductor 53 may be closely controlled by varying the flow rate of the compressed air from the reservoir 50, with the flow rate of aerated water varying only slightly in response to a change in the air flow rate. The valve 61 may be adjusted appropriately to further control the flow rate of aerated water to the flotation compartment 17.

In common with flotation apparatus of the prior art, a certain portion of those solids in the aqueous slurry, particularly that part commonly referred to as gangue, will, in time, tend to settle from the quiescent aqueous slurry to the bottom of the flotation compartment 17. Such non-float particles are not, by intent, generally captured and levitated by the air bubbles, thereby enabling the concentration of the desired valuable minerals. As the gangue particles migrate downwardly in the flotation compartment 17, they are precluded from passing through the orifices 16 in the constriction plate 14 by the upwardly acting pressure of the aerated water inserted into the hydraulic compartment 18 of the flotation apparatus 10. Such gangue particles are thus diverted from their downward paths so as to reach the constriction plate 16 at regions adjacent the orifices 16 whereat they will tend to migrate to the hole 28 and thence into the underflow duct 29 for removal from the system. Since the underflow duct 29 is not primarily required for the withdrawal of excess water, as may be necessary in the high water flow rate systems previously known, the removal of gangue may be accomplished on an "as required" rather than continuous basis. Additionally, should any gangue particles inadvertently gravitate downwardly through the orifices 16 in the constriction plate 14, they will not be drawn from the hydraulic chamber 18 since no recirculation of water is contemplated. Rather, they will merely come to rest on the bottom wall 12 of the cylinder, from which location they may be removed from time to time by emptying the cylinder and opening one or more cleaning entry ports 30 disposed through the bottom wall 12 of the cylinder. This feature provides dual advantage in that any such non-floated particles will not contaminate pumping or other portions of the system and the non-floated particles may be reintroduced at the top of the flotation compartment 17 to recover any particles of the desired valuable mineral that may have migrated downwardly to the bottom without being captured by an air bubble for flotation concentration.

By way of a further advantageous comparison of the flotation apparatus 10 of the present invention with respect to similar devices heretofore known, the volumes of water necessary to be moved and aerated through prior known systems, either as external water or as recirculated water, typically are at a rate exceeding twelve hundred gallons per minute, requiring the expenditure of significant energy through motors driving the pumps associated with moving the water, while in the flotation apparatus of the present invention, the energy input required is limited to that necessary to drive the air compressor 49. In an experimental system in accordance with the present invention, modified from an existing system of the type described in U.S. Pat. No. 4,394,258, the air compressor is operated by an electric motor rated at twenty-five horsepower, whereas the electric motor driving the pump of the prior system typically required in excess of sixty horsepower to provide an essentially identical flow of air bubbles through the flotation chamber.

While the above-described embodiment of a flotation apparatus in accordance with the present invention has utilized, as an example, the flotation separation of an aqueous slurry containing nominally ten percent particulate matter by volume, as exemplified by sulfides, the apparatus will function as described for the efficient separation of slurries having a solid particulate concentration of approximately twenty-five percent or greater, by volume, which is within the range of slurries encompassing coal. Aqueous slurries having higher volumetric densities of particulate matter, such as the phosphates, in which the solid particles form nominally seventy-five percent of the volume, may be subjected to flotation separation by the apparatus of the present invention by merely diluting the pulp with additional water to bring the slurry within the volumetric density range set forth herein, such dilution occuring prior to feeding the pulp to the flotation compartment.

While there have been described above the principles of this invention in connection with specific apparatus, it is to be clearly understood that this description is made only by way of example and not as a limitation to the scope of the invention.

What is claimed is:

1. Apparatus for separation of minerals by froth flotation from an aqueous pulp containing a mixture of mineral and gangue particles comprising:

a flotation compartment adapted to contain a relatively quiescent body of said aqueous pulp;

pulp feed means for introducing an aqueous pulp into said flotation compartment;

froth overflow means, disposed adjacent to an upper end of the flotation compartment, for discharging from said flotation compartment a float fraction containing floated particles of said aqueous pulp;

a hydraulic compartment, disposed adjacent to a bottom portion of the flotation compartment, said hydraulic compartment being adapted to contain a body of aerated water maintained at a higher static pressure than that of the aqueous pulp in a lowermost portion of the flotation compartment;

a stationary constriction plate forming the top of said hydraulic compartment and the bottom of said flotation compartment and extending substantially horizontally therebetween, said constriction plate having a plurality of spaced orifices therethrough for uniformly distributing aerated water as a stream of aerated water through each orifice from the hydraulic compartment to the flotation compartment;

underflow means for controllably discharging a non-float fraction containing unfloated particles of said aqueous pulp from said flotation compartment, said underflow means including a discharge duct which opens through said constriction plate;

at least one means for introducing aerated water into said hydraulic compartment and for forming a multitude of air bubbles throughout the water in the hydraulic compartment, said means for introducing aerated water including means for producing a controllably flowing stream of pressurized air, a controllable water supply means, and means for aspirating said water into said stream of air.

2. The apparatus of claim 1 wherein said discharge duct is disposed centrally of said constriction plate and said hydraulic compartment.

3. The apparatus of claim 1 wherein said at least one means for introducing aerated water into said hydraulic compartment includes a Venturi region disposed in the flow path subsequent but adjacent to said means for aspirating water into said stream of air.

4. The apparatus of claim 1 wherein said discharge duct is disposed in a central portion of said constriction plate, said constriction plate further comprising an upwardly facing surface upwardly inclining outwardly of said discharge duct whereby non-float fraction which tends to settle on said constriction plate will gravitate towards said discharge duct.

5. The apparatus of claim 1 wherein said at least one means for introducing aerated water into said hydraulic compartment further comprises a distributing manifold disposed within said hydraulic compartment.

6. The apparatus of claim 5 wherein said distributing manifold comprises an annular distributing conduit disposed concentric with and external to said discharge duct and a plurality of radially extending perforated distributing tubes communicating with said annular conduit.

7. The apparatus of claim 6 wherein said annular distributing conduit includes a plurality of spaced orifices in communication with said hydraulic compartment.

8. The apparatus of claim 1 wherein said flotation compartment is of an upright circularly cylindrical form, said hydraulic compartment and said constriction plate being of a size substantially coextensive with the cross-section of said flotation compartment.

9. The apparatus of claim 5 further comprising a second perforated aerated water distributing manifold disposed within the lower portion of said flotation chamber above said constriction plate, said second manifold communicating with the outflow end of said Venturi region.

10. The apparatus of claim 1 further comprising at least one sealable cleaning access port into said hydraulic compartment through a bottom wall thereof.

11. Apparatus for separation of minerals by froth flotation from an aqueous pulp containing a mixture of mineral and gangue particles comprising:

a flotation compartment adapted to contain a relatively quiescent body of said aqueous pulp;

feed means for introducing said aqueous pulp into said flotation compartment;

froth overflow means disposed adjacent an upper end of the flotation compartment for discharging therefrom a float fraction containing floated particles of said aqueous pulp;

a hydraulic compartment disposed beneath the flotation compartment, said hydraulic compartment being adapted to contain a body of aerated water maintained at a higher static pressure than that of the aqueous pulp in a lowermost portion of the flotation compartment;

a constriction plate forming the top of said hydraulic compartment and bottom of said flotation compartment, said constriction plate having a plurality of spaced orifices for uniformly distributing aerated water thereacross as a like plurality of streams including air bubbles from said hydraulic compartment to said flotation chamber;

an aerated water distributing manifold disposed within said hydraulic compartment adapted to distribute aerated water substantially uniformly therein;

means for producing a controllable stream of pressurized air;

external water supply means;

an eductor through which said stream of said pressurized air is passed such that a controlled quantity of said water is aspirated into said stream;

means for controllably introducing a surfactant into the quantity of water introduced into said eductor;

means for turbulently mixing said aspirated water and surfactant into said stream of air to form a stream of aerated water;

means for communicating said stream of aerated water to said aerated water distributing manifold;

means for discharging a non-float fraction of said aqueous pulp from said flotation compartment.

12. The apparatus of claim 11, further comprising a second aerated water distributing manifold disposed within said lower portion of said flotation compartment, and means for communicating a portion of said stream of said aerated water thereto.

13. The apparatus of claim 11, wherein said means for producing a controllably flowing stream of pressurized air comprises:

an air compressor, adapted to acquire atmospheric air and raise the static pressure thereof;

an accumulator adapted to hold a supply of pressurized air;

means for communicating pressurized air from said compressor to said accumulator;

means for communicating pressurized air from said accumulator to said eductor;

valve means, disposed between said accumulator and said eductor, for controlling the flow of said pressurized air therebetween; and means for driving said air compressor.

14. The apparatus of claim 11, wherein said means for turbulently mixing said aspirated water and said surfactant into said stream of air includes a Venturi region adjacent an output of said eductor.

15. The apparatus of claim 11, further comprising a plurality of eductors, each having associated therewith an input passage for pressurized air, an input passage for the aspiration of water and surfactant into the respective stream of pressurized air, and an output passage communicating with a respective one of a like plurality of Venturi regions, said plurality of eductors receiving the pressurized air, aspirated water and injected surfactant in a parallel arrangement, the resulting outputs of aerated water respectively being combined for communication to said means for communicating said stream of aerated water to said aerated water distributing manifold.

16. The apparatus of claim 15, further comprising a plurality of valves disposed, respectively, so as to control an output flow of aerated water from each of said Venturi regions.

17. In an apparatus for separation of minerals by froth flotation from an aqueous pulp containing a mixture of mineral and gangue particles, said apparatus including means for removing a froth of a float fraction of the aqueous pulp at a substantially continuous rate, and a hydraulic compartment wherein aerated water is distributed substantially uniformly to provide levitating air bubbles for upward passage through said aqueous pulp producing said froth, the improvement comprising:

means for providing a controllably flowing stream of pressurized air;

water supply means;

means for aspirating a controllable quantity of water into said flowing steam of said pressurized air, said aspiration resulting from the flow of said stream of pressurized air;

means for controllably introducing a flow of surfactant into said quantity of water aspirated; and means for turbulently mixing said flowing stream of pressurized air, said aspirated water, and said surfactant to produce a stream of aerated water for delivery to said hydraulic compartment.

* * * * *